US005704006A

United States Patent [19]

Iwahashi

[11] Patent Number: 5,704,006

[45] Date of Patent: Dec. 30, 1997

[54] METHOD FOR PROCESSING SPEECH SIGNAL USING SUB-CONVERTING FUNCTIONS AND A WEIGHTING FUNCTION TO PRODUCE SYNTHESIZED SPEECH

[75] Inventor: Naoto Iwahashi, Kanagawa, Japan

[73] Assignee: Sony Corporation, Tokyo, Japan

[21] Appl. No.: 527,142

[22] Filed: Sep. 12, 1995

[30] Foreign Application Priority Data

Sep. 13, 1994 [JP] Japan ..... 6-246867

[51] Int. Cl.[6] ..... G10L 5/04

[52] U.S. Cl. ..... 395/2.68; 395/2.11; 395/2.31; 395/2.41; 395/21; 395/156

[58] Field of Search ..... 395/2.11, 2.31, 395/2.33, 2.68, 21, 24, 2.41; 382/155–159

[56] References Cited

U.S. PATENT DOCUMENTS 5,070,515 12/1991 Iwahashi et al. .
5,115,240 5/1992 Fujiwara et al. .
5,396,577 3/1995 Oikawa et al. .

OTHER PUBLICATIONS

"Voice Quality Control by Speaker Interpolation Processing" by Iwahashi et al, Japan Acoustics Association Autumn Forum, Oct. 1993 [English Language Explanation of Relevance Attached Hereto].

"Voice Quality Conversion by Vector Quantization" by Abe et al, Japan Acoustics Association Autumn Forum, Oct. 1987 [English Language Explanation of Relevance Attached Hereto].

*Primary Examiner*—Allen R. MacDonald
*Assistant Examiner*—Alphonso A. Collins
*Attorney, Agent, or Firm*—Jay H. Maioli

[57] ABSTRACT

A parameter converting method and a speech synthesizing method for synthesizing speech with a voice quality similar to that of an input voice includes a parameter converting function constituted of a weighting function for setting weighting coefficients on an input sound spectrum parameter space and a plurality of sub-converting functions. Conversion outputs of the respective sub-converting functions are given weighting coefficients such that the sum of the weighted conversion outputs is used as the parameter converting function to convert M sound spectrum parameter to a single sound spectrum parameter. In this way, the freedom of adaptation with respect to the parameter converting function can be more properly set, so that the parameter converting function can provide an accuracy in accordance with an amount of speech data inputted for learning. It is therefore possible to provide a sound spectrum parameter for generating a voice quality much closer to that of an input voice.

29 Claims, 7 Drawing Sheets

METHOD FOR PROCESSING SPEECH SIGNAL USING SUB-CONVERTING FUNCTIONS AND A WEIGHTING FUNCTION TO PRODUCE SYNTHESIZED SPEECH

FIELD OF THE INVENTION

This invention relates to a parameter converting method and a speech synthesizing method, and more particularly, can be applied to output synthetic speech having a voice quality similar to that of a desired arbitrary speaker.

BACKGROUND OF THE INVENTION

Heretofore, in the field of speech synthesizing apparatus, investigations have been under way on a method for synthesizing speech with a voice quality similar to that of a particular speaker by converting parameters of speech spectra of one or a plurality of speakers which have been once generated or stored beforehand, i.e., a voice quality conversion. More specifically, the voice quality conversion involves inputting of finite speech uttered by an speaker under analysis to a voice quality conversion unit for use as part of learning data. Also, the sound spectrum of the same contents (the same phoneme series) as those uttered by the objective speaker, which has been once generated or stored beforehand, is prepared as learning data, in order to derive a parameter converting function which makes these parameters closer to the sound spectrum parameters of the objective speaker.

Once the parameter converting function is derived in this way, sound spectrum parameters of one or a plurality of speakers, which have been generated or stored beforehand by the speech synthesizing apparatus, are converted based on the parameter converting function. The converted spectrum parameters may be used for speech synthesis to enable the generation of speech in the voice quality of the objective speaker which has the contents other than those previously uttered by the objective speaker and inputted in the speech synthesizing apparatus.

In this voice quality converting method, desirably, a voice quality converting function is appropriately derived in accordance with an amount of learning data. More specifically, it is desirable that a fine spectrum converting function is derived when a large amount of learning data is provided, while an adequately acceptable spectrum converting function is derived even if a small amount of learning data is merely provided. Also, since voice data of the objective speaker cannot be always sufficiently provided, it would be desirable to realize appropriate voice quality conversions requiring only a few words uttered by a speaker.

Incidentally, several methods have been proposed as a voice quality adapting method. For example, in a method based on vector quantized code book mapping ("Voice Quality Conversion by Vector Quantization" by Abe et al, Japan Acoustics Association Autumn Forum, October 1987), for converting the spectrum of a speaker A into the spectrum of a speaker B, respective vectors in a vector code book generated from spectrum data of the speaker A (representing the spectral characteristics of the speaker A) are converted corresponding to vectors in a vector code book generated from spectrum data of the speaker B (representing the spectral characteristics of the speaker B), i.e., by code book mapping.

In addition, in a method based on speaker interpolation processing ("Voice Quality Control by Speaker Interpolation Processing" by Iwahashi et al, Japan Acoustics Association Autumn Forum, October 1993), voice data of a plurality of speakers are used as an empirical restricting condition (empirically revealed restricting condition), and a linear function is used as a converting function for controlling the voice quality. Since this method defines a strict restriction which only permits adaptation of weighting to a plurality of speakers, a relatively favorable spectrum converting function can be derived even with a small amount of learning data (data on a single uttered word).

However, the method based on vector quantized code book mapping has a problem that a large amount of data are required for achieving an appropriate spectrum conversion, i.e., the correspondence between code vectors, since appropriate restrictions are not given to the correspondence between the code vectors. This method, therefore, accepts even converting functions completely lacking in general smoothness or local consistency (converting functions which are not smooth even on a local basis) as possible converting functions. In other words, a problem lies in that the freedom of adaptation with respect to the converting function is higher than it should be.

The method based on speaker interpolation processing, in turn, has a problem that even if a large amount of learning data are provided, the resulting accuracy of the spectrum conversion is not so improved as compared with the case where only a small amount of learning data is provided. Thus, if a spectrum converting function with a much higher accuracy is to be derived, a problem arises that the freedom of adaptation with respect to the converting function must be increased in an appropriate manner.

SUMMARY OF THE INVENTION

In view of the foregoing, an object of this invention is to provide a parameter converting method which is capable of deriving a parameter converting function in accordance with an amount of input data.

Another object of the invention is to provide a speech synthesizing method which is capable of synthesizing speech having voice quality similar to that of input speech.

The foregoing objects and other objects of the invention have been achieved by the provision of a parameter converting method for converting M input parameters into N output parameters by using a predetermined parameter converting function, in which the parameter converting function is constituted of a weighting function for setting weighting coefficients on an input parameter space and a plurality of sub-converting functions, such that outputs of the respective sub-converting functions are applied with weighting coefficients, and the parameter converting function is expressed by the sum of the weighted conversion outputs.

This invention also provides a speech synthesizing method for converting M input sound spectrum parameters into a single sound spectrum parameter by using a predetermined parameter converting function to synthesize speech, in which the parameter converting function is constituted of a plurality of sub-converting functions, such that the plurality of sub-converting functions are selectively used to convert the M sound spectrum parameters into the single sound spectrum parameter.

This invention further provides a speech synthesizing method for converting M input sound spectrum parameters into a single sound spectrum parameter by using a predetermined parameter converting function to synthesize speech, in which the spectrum parameter converting function is constituted of a weighting function for setting weighting coefficients on an input sound spectrum parameter space and a plurality of sub-converting functions, such that conversion outputs of the respective sub-converting functions are applied with weighting coefficients, and the sum of the weighted conversion outputs is used as the parameter converting function to convert the M sound spectrum parameters into the single sound spectrum parameter.

A parameter converting function is constituted of a weighting function for setting weighting coefficients on an input parameter space and a plurality of sub-converting functions, such that a weighting coefficient is given to a conversion output of each sub-converting function to express the parameter converting function as the sum of the weighted conversion outputs, so that the freedom of adaptation with respect to the parameter converting function can be properly set, thereby making it possible to provide a highly accurate parameter converting function in accordance with an amount of input data.

Also, in the present invention, since the parameter converting functions is constituted of a plurality of sub-converting functions such that the plurality of sub-converting functions are selectively used to convert M sound spectrum parameters into a single sound spectrum parameter, the freedom of adaptation with respect to the parameter converting function can be properly set, so that the parameter converting function can be provided with an accuracy corresponding to an amount of speech data inputted for learning. It is therefore possible to provide a sound spectrum parameter for generating a voice quality similar to that of input speech.

Further, in the present invention, the parameter converting function is constituted of a weighting function for setting weighting coefficients on an input sound spectrum parameter space and a plurality of sub-converting functions, and weighting coefficients are given to conversion outputs by the respective sub-converting functions such that the sum of the respective weighted conversion outputs is used as the parameter converting function to convert M sound spectrum parameters into a single sound spectrum parameter, so that the freedom of adaptation with respect to the parameter converting function can be more properly set, thereby making it possible to provide a sound spectrum parameter for generating a voice quality much closer to that of input speech.

The nature, principle and utility of the invention will become more apparent from the following detailed description when read in conjunction with the accompanying drawings in which like parts are designated by like reference numerals or characters.

DETAILED DESCRIPTION OF THE EMBODIMENT

Figure 1:
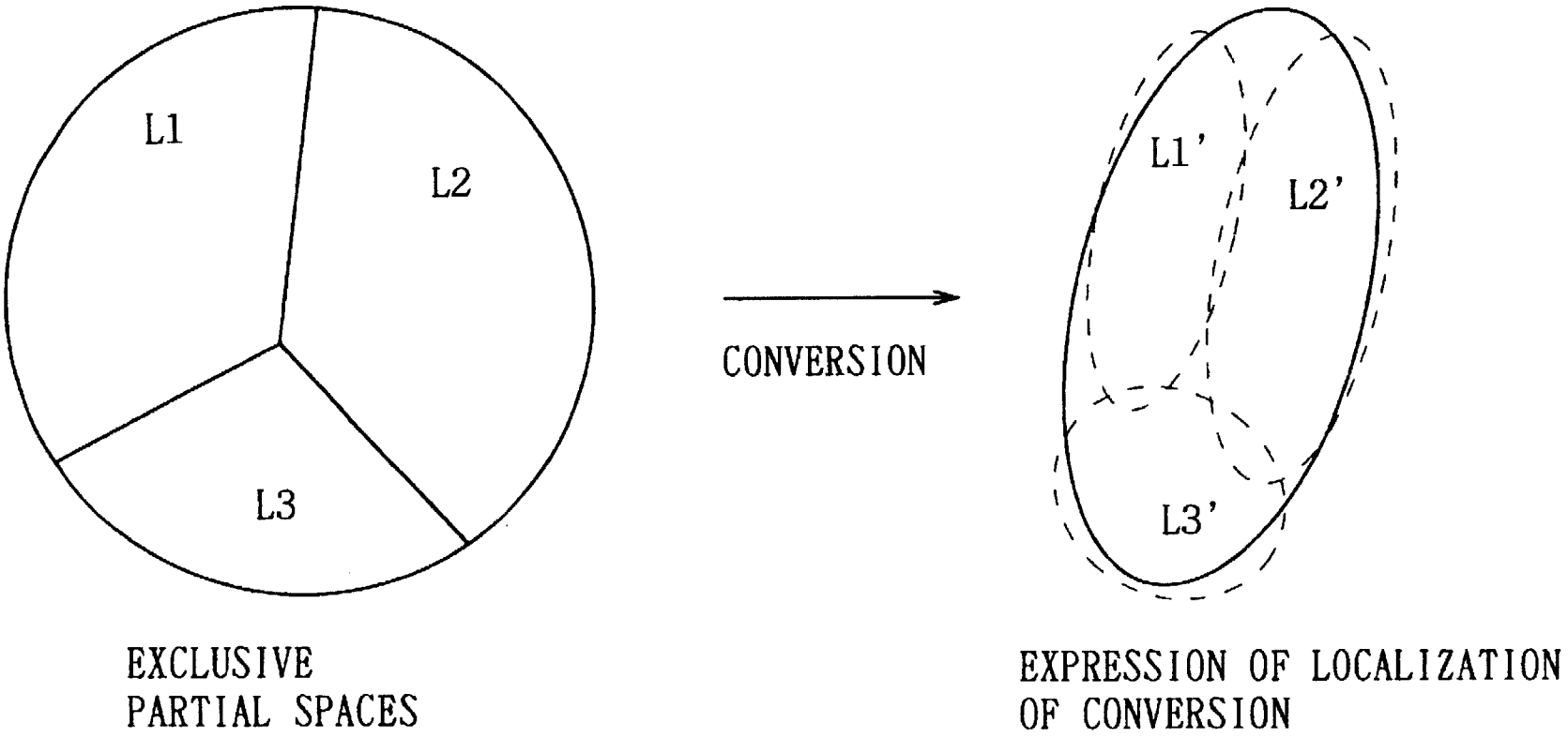
FIG. 1 is a diagram for explaining exclusive partial spaces and the expression of the localization of conversion.

Preferred embodiments of this invention will be described with reference to the accompanying drawings. As shown in FIG. 1, a speech synthesizing method according to this invention employs a plurality of sub-converting functions performing relatively simple conversion, and applies the plurality of sub-converting functions to exclusive partial spaces in a parameter (vector) space of previously stored sound spectrum, thereby improving the freedom of adaptation with respect to the converting function, realizing a much more accurate parameter converting function, and appropriately expressing the localization of the conversion. Exclusive partial spaces L1, L2, L3 are respectively converted into L1', L2', L3' by a converting function to express the localization of the conversion. For each of the plurality of sub-converting functions, a linear function, a polynomial function including second order or higher terms, a function expressed by a simply structured neural network, and so on may be employed.

Also, the use of the sum of weighted outputs converted by the plurality of relatively simple sub-converting functions as a parameter converting function largely improves the freedom of adaptation with respect to the converting function. Weighting coefficients for this parameter function are determined by a function defined on a sound spectrum parameter space which has previously been stored in a speech synthesizing apparatus (hereinafter called "the weighting function.").

The weighting function is provided for determining weighting coefficient vectors given to respective conversions on a spectrum parameter (vector) space, and is constituted of a radial basis function in this embodiment. The use of this function enables a fuzzy partition on the parameter (vector) space to be efficiently realized with a less number of parameters, i.e., with a lower freedom. The radial basis function receives a one- or more dimensional vector as an input, and outputs a scalar value. This is a function which generates an output value that is non-increasing for an increase in the distance between an input vector and a predetermined central vector. The fuzzy partition in turn refers to the employment of two or more interpolated functions as a function in a certain section.

As a radial basis function used for the weighting function, a Gaussian Kernal function $G_1(z)$ as shown in the following equation:

$$G_1(z) = \exp\left\{ -\frac{\|z-c\|}{2\sigma^2} \right\} = \exp\left\{ -\frac{1}{2\sigma^2} \sum_{m=1}^{M} (z_m - c_m)^2 \right\} \quad (1)$$

can be used. In the equation (1), "z" represents an M-dimensional input vector to the Gaussian Kernel function; "c" represents an M-dimensional central vector; and "r" represents a normalizing factor.

Parameters (vectors) for the plurality of the sub-converting functions and a parameter (vector) of the weighting function are determined by alternately updating the parameters (vectors) of the plurality of the sub-converting functions and the parameter (vector) of the weighting function. In this way, it is possible to simultaneously optimize the parameters (vectors) of the plurality of the sub-converting functions and the parameter (vector) of the weighting function.

Also, since the freedom of adaptation with respect to the converting function can be arbitrarily varied by changing the number of sub-converting functions to be used, an appropriate parameter converting function can be derived in accordance with an amount of learning data by setting the number of sub-converting functions to an appropriate value. Specifically, an appropriate parameter converting function can be constantly derived in accordance with a given amount of learning samples by decreasing the number of sub-converting functions when the amount of learning data is small and by increasing the number of sub-converting functions as more learning data is provided. In this way, the speech synthesizing method according to the present invention can appropriately convert a voice quality in accordance with an amount of learning samples. An embodiment of the present invention will now be described. First, a general processing flow will be described for a rule speech synthesizing apparatus, and then the rule speech synthesizing apparatus and learning processing for a spectrum parameter converting function will be described in detail.

Figure 2:
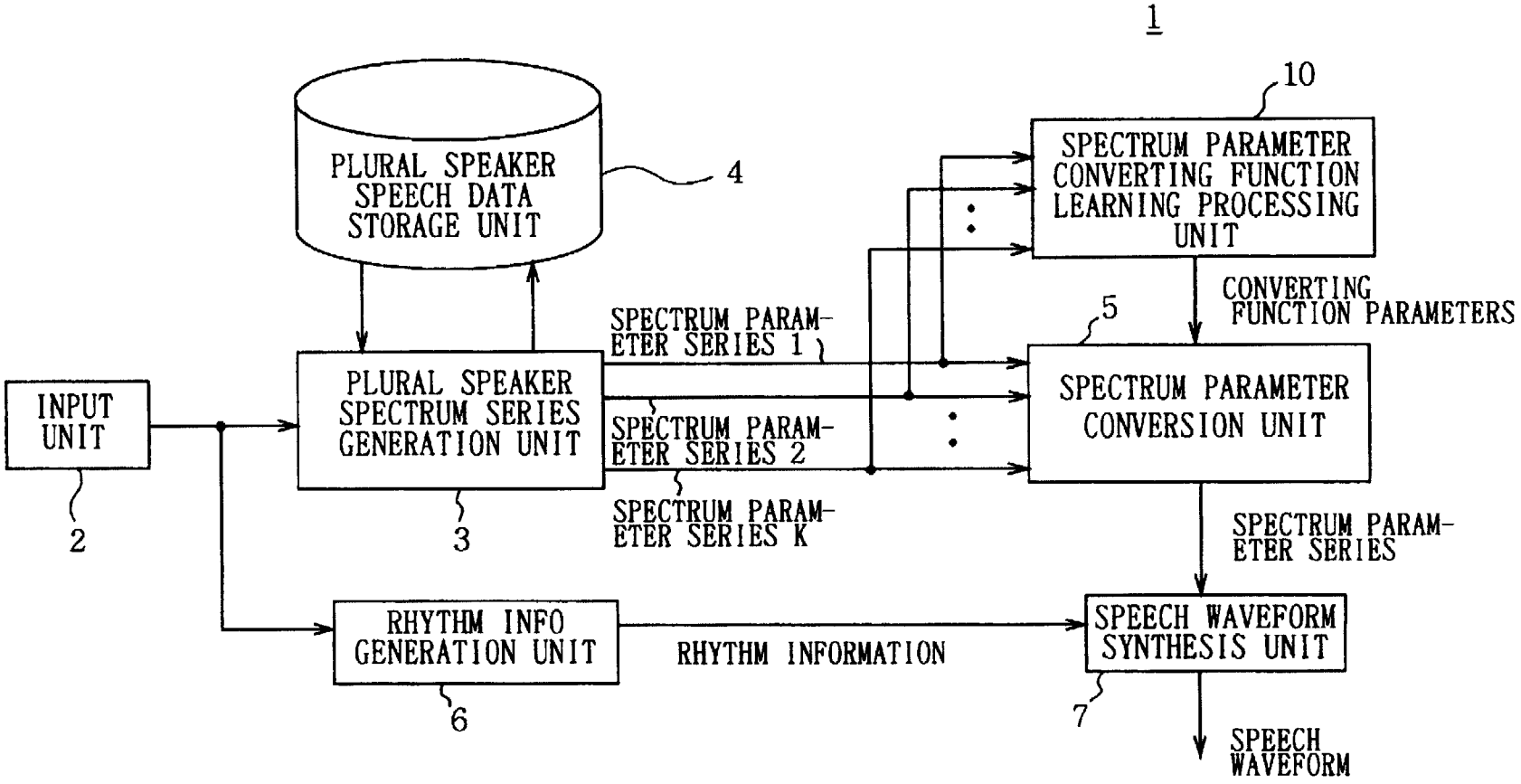
FIG. 2 is a block diagram showing a rule speech synthesizing apparatus with a voice quality converting function according to an embodiment of the present invention.

In FIG. 2, reference numeral 1 generally designates a rule speech synthesizing apparatus according to an embodiment of the present invention. In the rule speech synthesizing apparatus 1, rule speech synthesis input information (including phoneme series information, accent information, and so on), which is capable of representing the contents of arbitrarily uttered speech, is inputted from an input unit 2 to a plural speaker spectrum series generation unit 3. In the plural speaker spectrum series generation unit 3, K spectrum series (vectors) corresponding to speech having the contents described in the rule speech input information inputted from the input unit 2 are generated using spectrum data of a number of people (in this case, the number is K) stored in a plural speaker speech data storage unit 4.

In the spectrum parameter conversion unit 5, plural speaker spectrum parameters (vectors) generated in the plural speaker spectrum series generation unit 3 are converted by a parameter converting function previously determined by learning, to generate a spectrum parameter series (vector). Also, a rhythm information generation unit 6 generates rhythm information required for speech synthesis (basic frequency, phonemic power, phoneme duration time) based on the speech synthesis input information inputted from the input unit 2, and outputs the rhythm information to a speech waveform synthesis unit 7.

Figure 3:
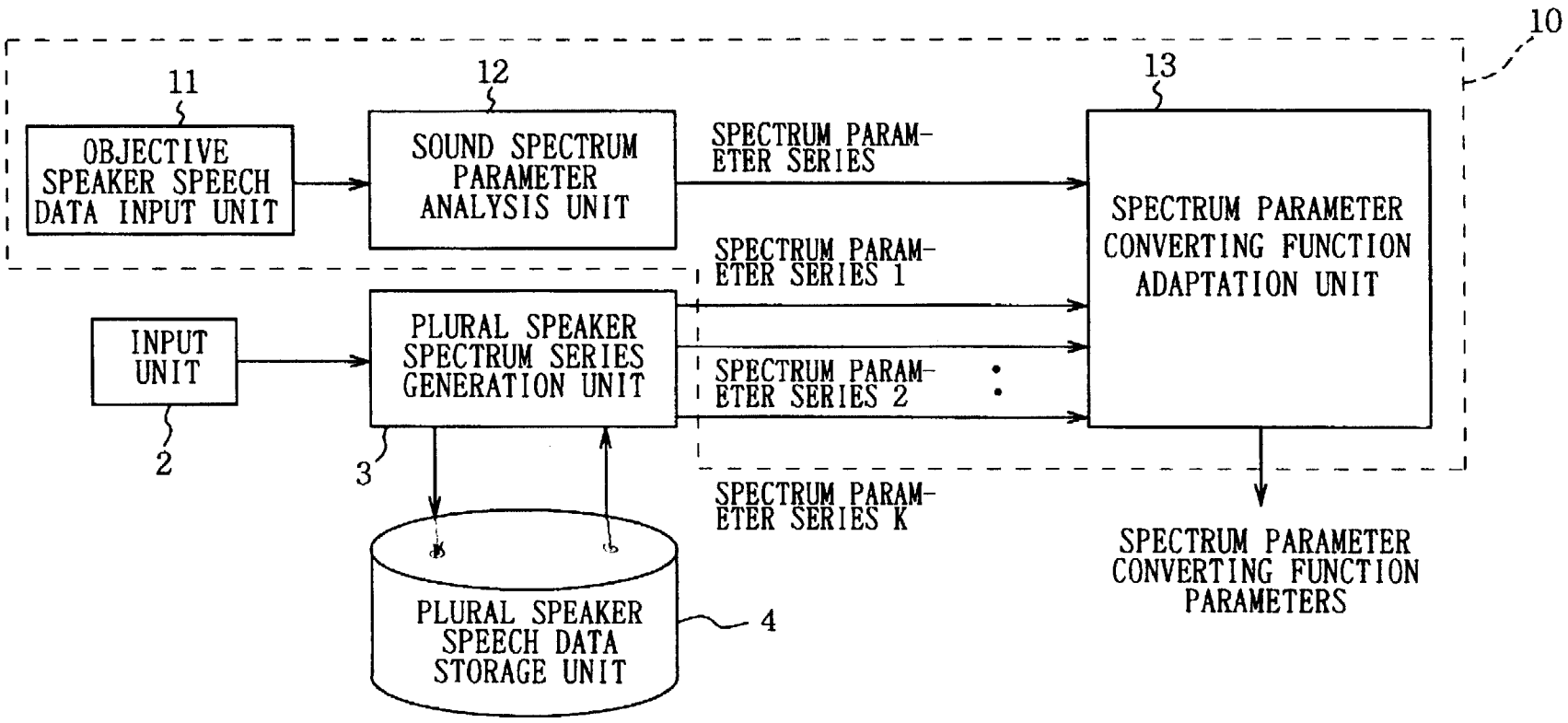
FIG. 3 is a block diagram showing an learning processing unit for a spectrum parameter converting function according to an embodiment of the present invention.

A parameter converting function learning processing unit 10 is now shown in FIG. 3. In FIG. 3, speech uttered by an objective speaker is inputted from an objective speaker speech data input unit 11 to a sound spectrum parameter analysis unit 12 for learning purpose. In the sound spectrum parameter analysis unit 12, the input objective speaker speech data is analyzed to calculate an objective speaker sound spectrum parameter (vector). Also, rule speech synthesis input information comprising the same phoneme series as that of the objective speaker's speech is inputted to the plural speaker spectrum series generation unit 3 from the input unit 2.

The plural speaker spectrum series generation unit 3 generates a plurality of sound spectrum parameter time-series (vectors) from a plurality of speaker data including the same phoneme series as phoneme series of speech inputted from the objective speaker speech data input unit 11. A spectrum parameter converting function adaptation unit 13 derives a parameter converting function which performs a conversion from the plurality of sound spectrum parameters (vectors) generated in the plural speaker spectrum series generation unit 3 to the sound spectrum parameter (vector) calculated in the sound spectrum parameter analysis unit 12 with the highest possible accuracy, and outputs a parameter representative of this parameter converting function (spectrum parameter converting function parameter) to the spectrum parameter conversion unit 5. This parameter converting function is derived so as to reduce the difference between a converted spectrum parameter (vector) and a sound spectrum parameter (vector) for learning.

The speech waveform synthesis unit 7 synthesizes a speech waveform using the spectrum parameter series (vector) generated in the spectrum parameter conversion unit 5 using the parameter converting function derived in the spectrum parameter converting function adaptation unit 13 and the rhythm information generated in the rhythm information generation unit 6, and outputs the synthesized speech waveform. This speech waveform synthesis is described in "Prior Art" of U.S. Pat. No. 5,396,577 (which corresponds to Japanese Laid-open Patent Publication published on Apr. 16, 1993).

In this way, by constituting the parameter converting function for use in the spectrum parameter conversion unit 5 in the rule speech synthesizing apparatus 1 of the parameter representative of the parameter converting function derived by the above-mentioned learning processing, it is possible to output speech including arbitrary contents with a voice quality close to that of the objective speaker.

Next, explanation will be given of the processing for synthesizing speech including arbitrary contents with a desired voice quality, using a given parameter converting function. If speech representative of a sentence "It is raining today.", for example, is to be synthesized, speech synthesis input information on a phoneme series containing "it iz réinin tudéi" is inputted from the input unit 2 to the plural speaker spectrum series generation unit 3. Here, "'" represents the position of accent in each word. The plural speaker spectrum series generation unit 3 synthesizes speech including the contents exactly the same as this phoneme series, using speech data previously stored in the plural speaker speech data storage unit 4.

Assuming that the number of speakers, speech data of which are stored in the plural speaker speech data storage unit 4, is "K", the plural speaker spectrum series generation unit 3 orderly uses the speech data of each of the K speakers from the plural speaker speech data storage unit 4 to generate K sound spectrum series (vectors) each including the contents exactly the same as the phoneme series of the speech synthesis input information. As a method of generating a spectrum series (vector) in the plural speaker series generation unit 3 using speech data of respective speakers, a rule speech synthesizing system may be used, an example of which is shown in "Composite Speech Unit Selection Method Based on Acoustic Rule" by Iwahashi et al, Reports on Technological Research of the Institute of Electronics, Information and Communication Engineers, SP91-5, May 1991.

It is assumed herein that each spectrum parameter series (vector) outputted from the plural speaker spectrum series generation unit 3 is represented by spectrum parameter time-series (vectors) of each time frame, and the spectrum (vector) of each time frame is represented by J spectrum parameter vectors. As the spectrum parameter (vector), an LPC (linear predictive coding) parameter, a spectrum parameter, or the like may be used by way of example. Assuming also that a time width of one frame is 5, and a j-th spectrum parameter of an i-th frame synthesized by data of k-th speaker within a plural speaker speech database is expressed by $X_{ijk}$, a spectrum parameter information vector Xi of synthetic speech for K speakers in the i-th frame is represented by the following equation:

$$X_i = \begin{bmatrix} x_{i11} & \cdot & \cdot & x_{i1k} \\ \cdot & \cdot & & \cdot \\ \cdot & & \cdot & \cdot \\ x_{ij1} & \cdot & \cdot & x_{ijk} \end{bmatrix} \quad (2)$$

In the equation (2), "J" is the number of spectrum parameters (vectors) in one frame, and "K" is the number of spectrum series which is generated in the plural speaker spectrum series generation unit 3 for single speech synthesis input information. As the spectrum parameter converting function used in the spectrum parameter conversion unit 5, a converting function F represented by a weighted sum of converting functions of the number of L as shown in the following equations:

$$\begin{aligned} Y_i &= F(X_i) \quad (3) \\ &= [F_1(X_i), \ldots, F_L(X_i)] \cdot g_i \end{aligned}$$

$$g_i^T = [g_1(X_i), \ldots, g_L(X_i)] \quad (4)$$

Here, in the equation (4), the following equation is satisfied:

$$\sum_{l=1}^{L} g_l(X_i) = 1 \quad (\forall_i) \quad (5)$$

"$F_l(.)$" represents an l-th converting function within the converting functions of the number of L, and a vector "$g_i$" is a weighting coefficient vector representative of a weighting coefficient applied to the converting functions of the number of L for data in an i-th frame. The weighting vector is a vector, elements of which are outputs of a function gl, l=1, 2, . . . , L. A vector "$Y_i$" represents a converted spectrum parameter vector of an i-th frame.

In this case, when a linear conversion is used for each of the converting functions of the number of L, "F" is expressed by the following equation:

$$F(X_i) = (X_i A + B) \cdot g_i \quad (6)$$

where "A", "B" are respectively expressed by the following equations:

$$A = \begin{bmatrix} a_{11} & \cdot & \cdot & a_{1L} \\ \cdot & \cdot & & \cdot \\ \cdot & & \cdot & \cdot \\ a_{K1} & \cdot & \cdot & a_{KL} \end{bmatrix} \quad (7)$$

$$B = \begin{bmatrix} b_{11} & \cdot & \cdot & b_{1L} \\ \cdot & \cdot & & \cdot \\ \cdot & & \cdot & \cdot \\ b_{J1} & \cdot & \cdot & b_{JL} \end{bmatrix} \quad (8)$$

In the equations (7) and (8), "L" represents the number of linear functions, and "$F_{al}(.)$" represents an l-th linear conversion. "$a_{kl}$" represents a k-th coefficient in a first-order term of an l-th linear conversion, and "$b_{jl}$" is the value of a j-th element of a constant vector in the l-th linear conversion. "$g_l(.)$" is a weighting function which receives the spectrum parameters (vectors) X of a plurality of speakers as inputs and outputs a weighting coefficient to be applied to an l-th linear conversion.

Figure 4:
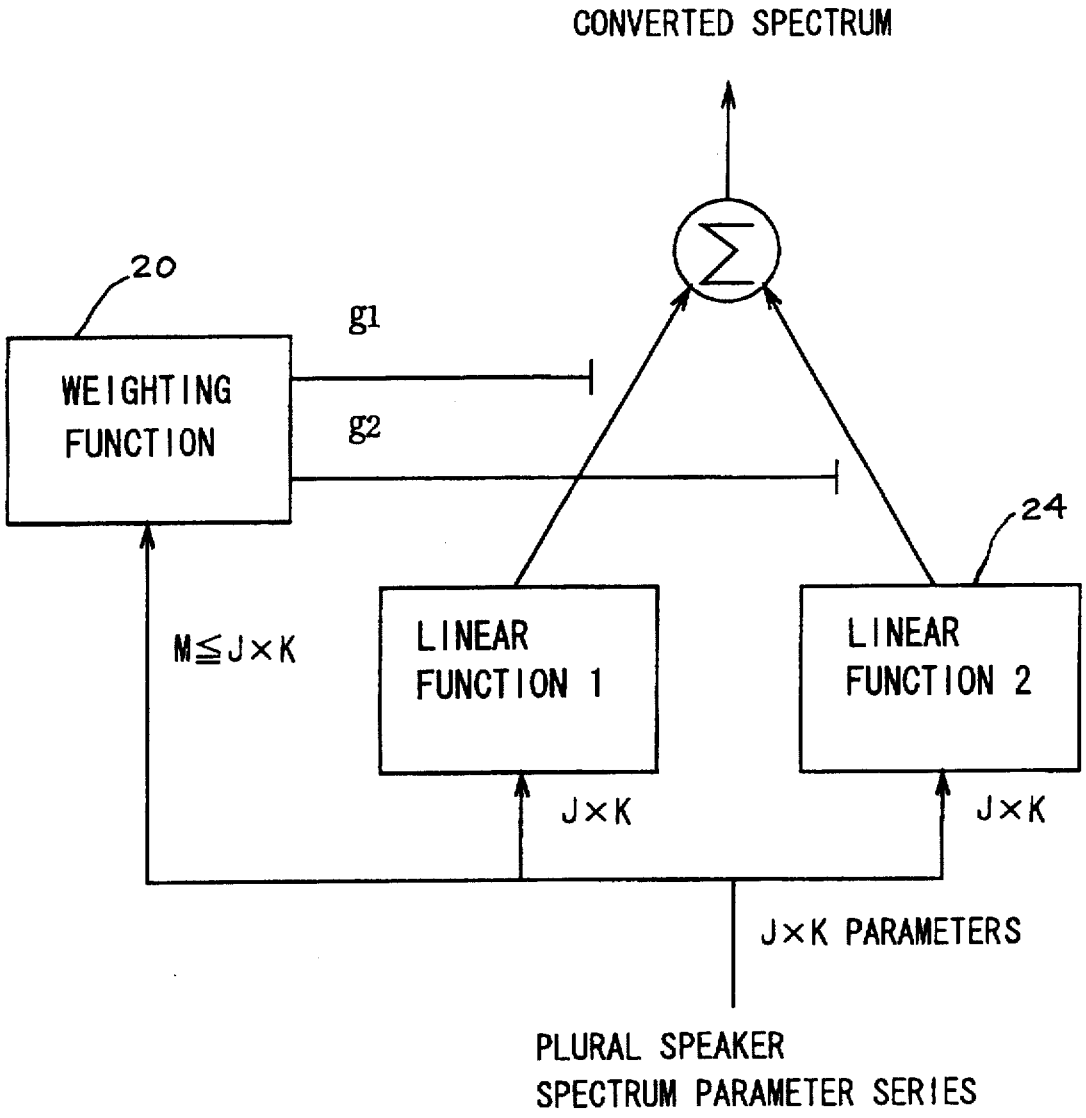
FIG. 4 is a block diagram showing the structure of the spectrum parameter converting function in the embodiment.
Figure 5:
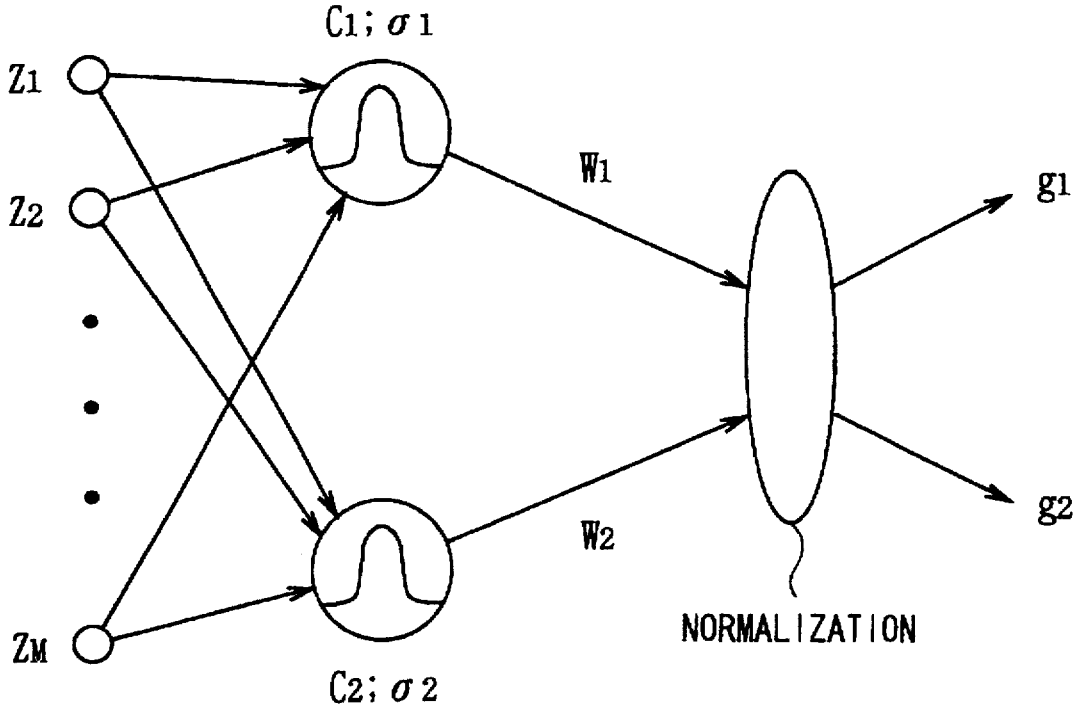
FIG. 5 is a schematic diagram showing the structure of a weighting function in the embodiment.

FIG. 4 shows the structure of the spectrum parameter conversion using the weighting function 20 and the plurality of linear functions 22, 24 defined by the equations as described above. The weighting function 20 is constituted of radial basis functions. It should be noted herein that for determining a weighting function, J×K parameters may not be used, and the spectrum of a particular speaker may be inputted by way of example. In FIG. 4, the structure is such that M parameters (≦J×K) are inputted. FIG. 5 shows the structure of a weighting function having two radial basis functions. In FIG. 5, a Gaussian Kernel function, which is a radial basis function, is used in a second layer of the weighting function. This Gaussian Kernel function is defined by the following equation:

$$\begin{aligned} O_q &= \exp\left\{ -\frac{\|z - c_q\|}{2\sigma_q^2} \right\} \quad (9) \\ &= \exp\left\{ -\frac{1}{2\sigma_q^2} \sum_{m=1}^{M} (z_m - c_{qm})^2 \right\} \end{aligned}$$

In the equation (9) "$z_m$" represents an m-th element of an M-dimensional vector which is an input to the weighting function, and "$c_q$" represents a central vector of a q-th Gaussian Kernel function Also, "$\sigma_q$" represents a normalizing factor of the q-th Gaussian Kernel function, and "$o_q$" represents an output of the q-th Gaussian Kernel function. The output of each Gaussian Kernel function, after being multiplied with a coefficient "$w_q$", is subjected to normalization processing expressed by the following equation:

$$g_p = \frac{w_p o_p}{\sum_{l=1}^{L} w_l o_l} \quad (p = 1, \ldots, L) \quad (10)$$

to derive an output vector of the weighting function. Here, "$g_p$" represents a p-th element of a weighting vector which is the output of the weighting function. Further, in the equation (10), the following equation is satisfied:

$$\sum_{l=1}^{L} w_l = 1 \quad (11)$$

The above-mentioned parameter converting function can be derived by learning with input sound spectrum parameter series (vectors) and sound spectrum parameter series (vectors) of a plurality of speakers generated by the rule speech synthesis representing the same phoneme series used as a learning sample set, as described above. The learning processing for the spectrum parameter converting function will be explained below.

As described above, the parameter converting function outputs new spectrum parameters (vectors) from sound spectrum parameter series (vectors) of a plurality of speakers inputted thereto. The parameter converting function is constituted of a plurality of linear conversions and a weighting function, expressed by vector A and vector B as the linear conversions and parameters $c_q$, $\sigma_q$, $w_q$ (q=1, . . . , L) as the weighting function, and derives these parameters by learning so as to make an evaluation function Q shown in the following equation as small as possible:

$$\begin{aligned} Q &\equiv \sum_{i=1}^{N} \|y_i - Y_i\| \quad (12) \\ &= \sum_{i=1}^{N} \left\{ \sum_{j=1}^{J} \left( y_{ij} - \sum_{l=1}^{L} g_{il} \left( \sum_{k=1}^{K} a_{kl} x_{ijk} + b_{jl} \right) \right)^2 \right\} \end{aligned}$$

"Q" is derived by first calculating a square of the difference between an objective speaker sound spectrum parameter (vector) and a spectrum parameter (vector) derived by converting a spectrum parameter (vector) generated in the plural speaker series generation unit 3 by a spectrum parameter converting function, for each elements in a learning sample set $T=((y_1, Y_1), (y_2, Y_2), \ldots, (y_N, Y_N))$, and adding all the calculated squares. Here, "$g_{il}$" is a weighting value for an l-th converting function outputted by the weighting function for an i-th learning sample. "N" is the number of samples for learning. Further, "yi" represents vectors of the number of J in an i-th frame of the sound spectrum of the objective speaker.

Actually, the learning of the spectrum parameter converting function is carried out in two separate processing steps, i.e., an optimization processing step for the plurality of linear functions and a gradual update processing step for parameters of the weighting function. These two processing steps are alternately executed during the repetitive optimization processing for the parameters.

First, the optimization processing for the plurality of linear functions will be explained. In this processing, the weighting values $g_{il}$ (i=1, . . . , N, l=1, . . . , L) applied to the linear functions are fixed. In this event, parameters $a_{kl}$, $b_{jl}$ representing the linear conversions are derived as solutions of the following simultaneous equations:

$$\sum_{i=1}^{N}\sum_{j=1}^{J}\left\{ g_{iq}x_{ijp}\sum_{l=1}^{L} g_{il}\left(\sum_{k=1}^{K} x_{ijk}a_{kl}+b_{jl}\right)\right\} = \sum_{i=1}^{N}\sum_{j=1}^{J} y_{ij}g_{iq}x_{ijp} \tag{13}$$

$$\sum_{i=1}^{N}\left\{ g_{is}\sum_{l=1}^{L} g_{il}\left(\sum_{k=1}^{K} x_{irk}a_{kl}+b_{rl}\right)\right\} = \sum_{i=1}^{N} y_{ir}g_{is} \tag{14}$$

$$(p=1,\ldots,K,\ g=1,\ldots,L,\ r=1,\ldots,J,\ s=1,\ldots,L)$$

The simultaneous equations can be derived by partially differentiating the evaluation function Q by the respective parameters of the linear conversions.

Next, the gradual update processing for the parameters of the weighting function will be explained. The update may be performed, for example, by a gradient descent method. More specifically, when an s-th element $c_{rs}$ of a central vector C of an r-th Gaussian Kernel function is to be updated, this operation is expressed by the following equation:

$$c_{rs}(t+1) = c_{rs}(t) - \mu\frac{\partial Q}{\partial c_{rs}}\bigg|_{\Phi(t)} \tag{15}$$

where "m" is a positive constant representing a learning speed coefficient which is set, for example, to 0.001, and "Φ(t)" represents all parameters which express the spectrum parameter converting function in the t-th repetitive processing. That is, $\Phi(t)=\{A(t), B(t), C(t), \sigma(t), w(t)\}$ is described. Partial differentiation of Q with respect to crs may be expressed by the following equation in accordance with a chain rule:

$$\begin{aligned}\frac{\partial Q}{\partial c_{rs}} &= \sum_{i=1}^{N}\frac{\partial d_i}{\partial c_{rs}} \\ &= \sum_{i=1}^{N}\sum_{p=1}^{L}\frac{\partial d_i}{\partial g_{ip}}\frac{\partial g_{ip}}{\partial c_{rs}} \\ &= \sum_{i=1}^{N}\sum_{p=1}^{L}\frac{\partial d_i}{\partial g_{ip}}\frac{\partial g_{ip}}{\partial o_{ir}}\frac{\partial o_{ir}}{\partial c_{rs}}\end{aligned} \tag{16}$$

In the equation (16), $\partial d_i/\partial g_{ip}$, $\partial g_{ip}/\partial o_{ir}$, and $\partial o_{ir}/\partial c_{rs}$ are respectively expressed by the following equations:

$$\begin{aligned}\frac{\partial d_i}{\partial g_{ip}} = \sum_{j=1}^{J}\Bigg\{ & 2\left(\sum_{k=1}^{K} x_{ijk}a_{kp}\right)\left(\sum_{k=1}^{K}\sum_{l=1}^{L} g_{il}x_{ijk}a_{kl}\right) + \\ & 2b_{jp}\sum_{l=1}^{L}(g_{il}b_{jl}) - 2y_{ij}\sum_{k=1}^{K}(x_{ijk}a_{kp}) - \\ & 2y_{ij}b_{jp} + 2b_{jp}\sum_{k=1}^{K}\sum_{l=1}^{L} g_{il}x_{ijk}a_{kl} + \\ & 2\sum_{k=1}^{K}(x_{ijk}a_{kp})\sum_{l=1}^{L}(g_{il}b_{jl})\Bigg\}\end{aligned} \tag{17}$$

$$\frac{\partial g_{ip}}{\partial o_{ir}} = \begin{cases} w_p\dfrac{1}{\sum_{l=1}^{L} w_l o_{il}} - \dfrac{w_p^2 o_{ip}}{\left(\sum_{l=1}^{L} w_l o_{il}\right)^2} & (P=r) - \\ \dfrac{w_p w_r o_{ip}}{\left(\sum_{l=1}^{L} w_l o_{il}\right)^2} & (p\neq r)\end{cases} \tag{18}$$

$$\frac{\partial o_{ir}}{\partial c_{rs}} = -\frac{1}{\sigma_r^2}(-z_{is}+c_{rs})\exp\left(-\frac{1}{2\sigma_r^2}\sum_{m=1}^{M}(z_{im}-c_{rm})^2\right) \tag{19}$$

where "$d_i$" represents a square of the difference in an i-th frame; "$z_{im}$" represents an m-th input value to an r-th Gaussian Kernel function for an i-th learning sample; and "$o_{ir}$" represents the output of an r-th Gaussian Kernel function for the i-th learning sample. Other parameters such as "$\sigma_l$", "$w_l$", and so on are also updated by similar processing.

Figure 6:
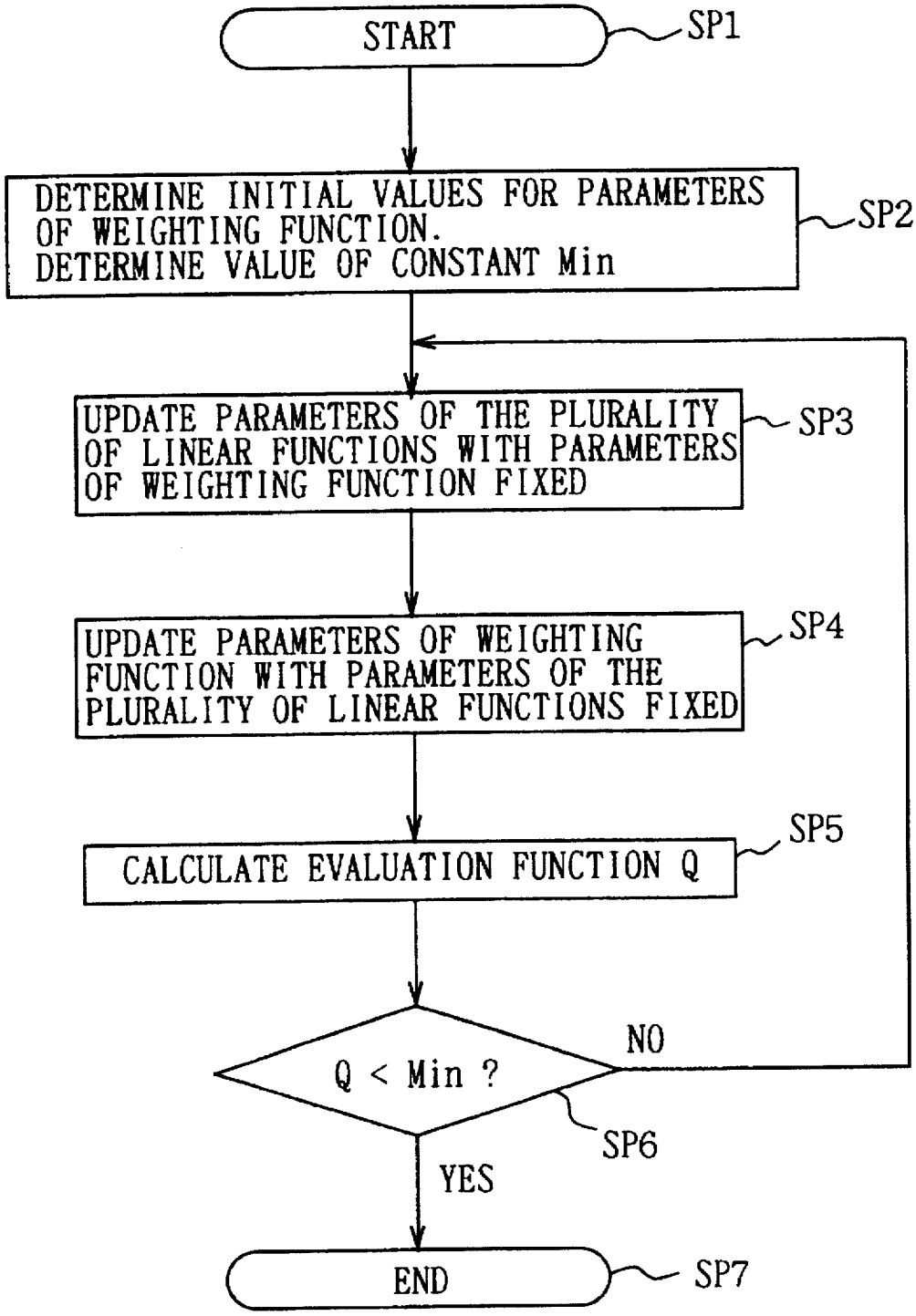
FIG. 6 is a flow chart showing a learning processing procedure for the spectrum parameter converting function.

The gradual optimization processing for the spectrum parameter converting function comprising a weighting function and a plurality of linear conversions is shown in a flow chart of FIG. 6. First, the processing starts at step SP1, and arbitrarily determines initial values for the parameters of the weighting function at step SP2. For example, $\sigma_q$ (q=1, . . . , L) is set to 0.1; $w_q$ (q=1, . . . , L) is set to 1/L; and $C_{rs}$ (r=1, . . . , L, s=1, . . . , M) is set to 0.0+ϵ (ϵ is a random number, the variance of which is approximately 0.1). As a parameter for a convergence condition, Min is set, for example, to 0.1 in accordance with an empirical rule.

Next, at step SP3, with the parameters of the weighting function being fixed, optimal values are derived for the parameters of the plurality of linear functions. Then, at step SP4, with the parameters of the plurality of linear functions being fixed, the parameters of the weighting function are updated. Next, at step SP5, the value of the evaluation function Q is derived. At step SP6, if the value of the evaluation function Q is equal to or more than Min, the processing returns to step SP3, and otherwise, the current parameter values are saved as the parameters of the spectrum parameter converting function, followed by the termination of the processing at step SP7.

The spectrum parameter conversion unit 5 uses the parameters derived in the foregoing manner to convert K spectrum parameter series generated in the spectrum parameter series generation unit 3 to a single spectrum parameter series. Then, the speech waveform synthesis unit 7 uses this spectrum parameter series and rhythm information generated in the rhythm information generation unit 6 to synthesize a speech waveform.

According to the foregoing configuration, the spectrum parameter converting function is constituted of two linear functions 22, 24 and the weighting function 20 having two radial basis functions and expressed by a weighted sum of conversion outputs generated by the two linear functions. A generated spectrum is converted by using this spectrum parameter converting function. In this way, spectrum parameters of a voice with voice quality similar to those of a voice inputted for learning can be derived, so that a voice having a voice quality similar to that of the speaker used for learning can be synthesized.

While the foregoing embodiment has been described for the case where the parameter converting function is constituted of two linear functions and a weighting function having two radial basis functions as sub-converting functions, the present invention is not limited to this particular number of sub-converting functions, and the parameter converting function may be constituted of three or more linear functions and radial basis functions.

In this case, since the freedom of the entire parameter converting function can be varied by changing the number of the linear conversions and the number of the radial basis functions in the weighting function as the sub-converting functions, the freedom of adaptation for the parameter converting function can be varied in accordance with the amount of learning samples. It is therefore possible to always realize favorable learning, taking advantage of the learning samples ($y_1$ to $y_N$) of the objective speaker. More specifically, since a relatively favorable spectrum parameter converting function can be derived even if a less amount of learning samples are only provided, a voice quality similar to that of a speaker used for learning can be generated correspondingly. On the contrary, as the amount of learning data is increased, a much more accurate spectrum parameter converting function can be derived, so that a voice quality much closer to that of a speaker used for learning can be generated.

For example, when speech of the objective speaker used as a learning sample includes approximately one to five words, the number of the linear functions is set to one. The weighting function is not necessary in this case. When the speech includes approximately six to ten words, the number of linear functions and the number of the radial basis functions in the weighting function are both set to two. Further, when the speech includes approximately 11 to 20 words, the numbers are both set to three.

Further, while the foregoing embodiment employs linear functions as the sub-converting functions, the present invention is not limited to this type of function, but a polynomial function including two or more terms, a function expressed by a neural network, or the like may also be employed as the sub-converting function. Further, while the foregoing embodiment employs Gaussian Kernel functions as the radial basis functions, the present invention is not limited to this type of function, but a distance function $G_2(z)$ as shown in the following equation may be employed:

$$G_2(z) = \|z - c\|^{-p} = \left(\sqrt{\sum_{m=1}^{M} (z_m - c_m)^2}\right)^{-p} \quad (20)$$

In this case, "z" represents an M-dimensional input vector to the distance function, and "c" represents an M-dimensional central vector. "p" is a constant.

Figure 7:
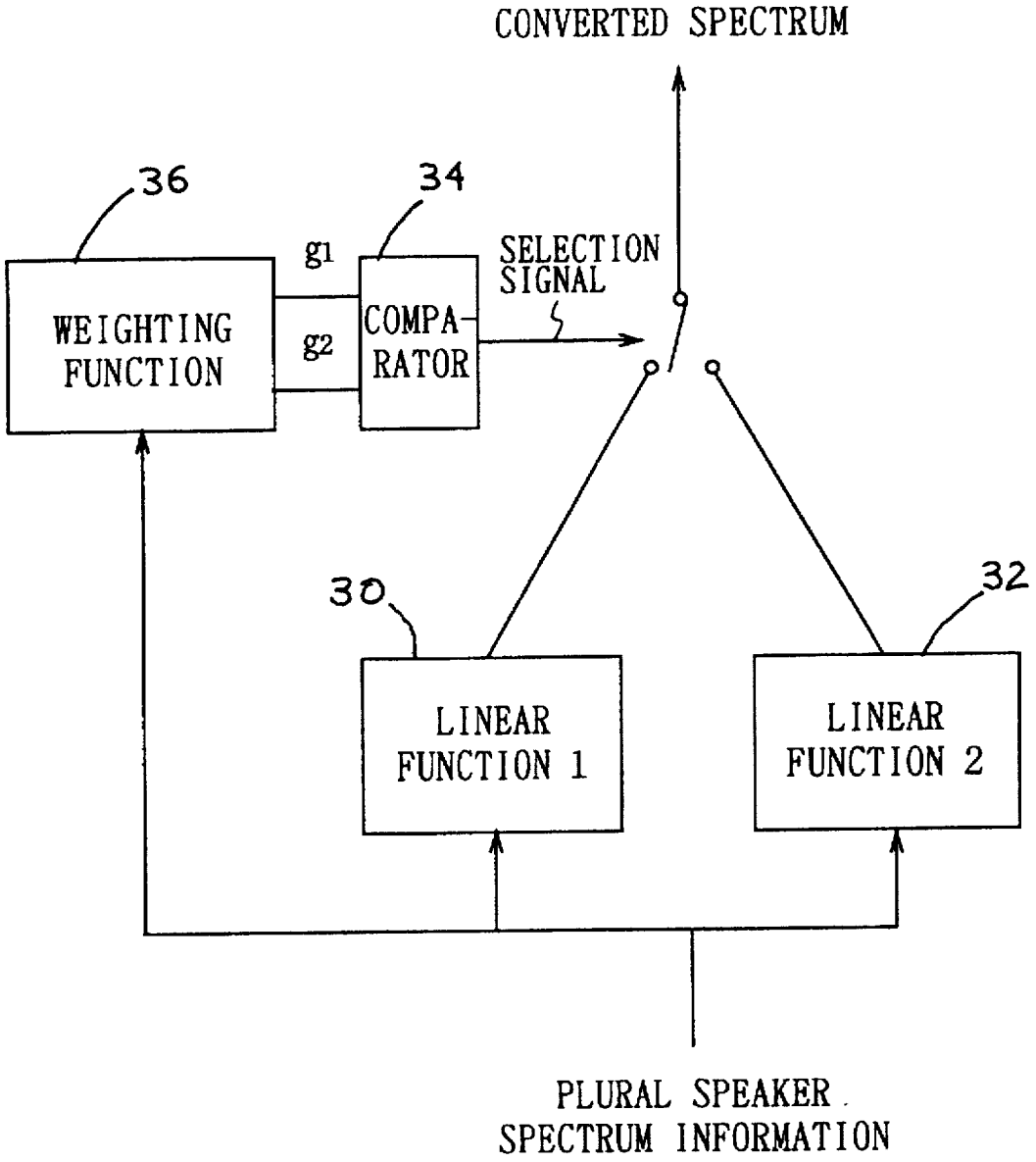
FIG. 7 is a block diagram showing another structure of the spectrum parameter converting function.

Furthermore, while the foregoing embodiment has been described for the case where the spectrum parameter converting function is constituted of sub-converting functions and a weighting function, the present invention is not limited to this constitution, but the spectrum parameter converting function may be constituted only of a plurality of sub-converting function such that the sub-converting functions are selectively used. For example, sub-converting functions corresponding to larger weighting coefficients may be selected from the outputs of two linear functions 30, 32 based on a comparison performed by a comparator 34 of two outputs g1 and g2 of the weighting function generator 36 (FIG. 7).

Furthermore, while the foregoing embodiment has been described for the case where the spectrum conversion is applied to speech synthesis, the present invention is not limited to this particular application, but can be applied to a general solution for a problem which learns input/Output mapping from learning points of given input parameters and output parameters, such as an economical index prediction for use in stock price prediction or the like, generation of patterns for computer graphics, control of industrial robots, pattern recognition such as speech recognition and image recognition, and so on.

According to the present invention as described above, a parameter converting function is constituted of a weighting function for setting weighting coefficients on an input parameter space and a plurality of sub-converting functions such that a weighting coefficient is given to a conversion output of each sub-converting function to express the parameter converting function as the sum of the weighted conversion outputs, so that the freedom of adaptation with respect to the parameter converting function can be properly set, thereby making it possible to provide a highly accurate parameter converting function in accordance with an amount of input data.

Also, according to the present invention, since the parameter converting function is constituted of a plurality of sub-converting functions such that the plurality of sub-converting function are selectively used to convert M sound spectrum parameters to a single sound spectrum parameter, the freedom of adaptation with respect to the parameter converting function can be properly set, so that the parameter converting function can be provided an accuracy corresponding to an amount of speech data inputted for learning. It is therefore possible to provide a sound spectrum parameter for generating a voice quality similar to that of input speech.

Further, according to the present invention, the parameter converting function is constituted of a weighting function for setting weighting coefficients on an input sound spectrum parameter space and a plurality of sub-converting functions, and weighting coefficients are given to conversion outputs by the respective sub-converting functions such that the sum of the respective weighted conversion outputs is used as the parameter converting function to convert M sound spectrum parameters to a single sound spectrum parameter, so that the freedom of adaptation with respect to the parameter converting function can be more properly set, thereby making it possible to provide a sound spectrum parameter for generating a voice quality much closer to that of input speech.

While there has been described in connection with the preferred embodiments of the invention, it will be obvious to those skilled in the art that various changes and modifications may be aimed, therefore, to cover in the appended claims all such changes and modifications as fall within the true spirit and scope of the invention.

What is claimed is:

1. A method for processing an input speech signal comprising the steps of:

receiving M-dimensional input vectors;

converting said M-dimensional input vectors to N output vectors in accordance with a predetermined parameter converting function;

said parameter converting function comprises a plurality of sub-converting functions and a weighting function for setting weighting coefficients on a space of said input vectors, said weighting function including a radial basis function having non-increasing output value for an increase in the distance between a central vector of the M-dimension defined on said input vector space and each said input vector;

said step of converting said M-dimensional input vectors to said N output vectors comprises the steps of converting said input vectors using said plurality of sub-converting functions to generate respective conversion outputs;

giving said weighting coefficients to said conversion outputs to generate weighted conversion outputs; and calculating the sum of said weighted conversion outputs to derive output vectors representative of the phonemes in said input speech signal.

2. The parameter converting method according to claim 1, wherein said radial basis function comprises a Gaussian Kernel function.

3. The parameter converting method according to claim 1, wherein said radial basis function comprises a distance function.

4. The parameter converting method according to claim 1, wherein said sub-converting functions comprise linear functions.

5. The parameter converting method according to claim 1, wherein said sub-converting functions comprise polynomial functions each including two or more terms.

6. The parameter converting method according to claim 1, wherein said sub-converting functions comprise a plurality of functions each expressed by a neural network.

7. A method for processing an input speech signal by determining parameters of a parameter converting function and making a predetermined conversion of input vectors to generate conversion output vectors, comprising:

a first step of providing a learning sample set including a predetermined number of learning samples each including a pair of M-dimensional vectors and N-dimensional vectors;

a second step of determining parameters of a weighting function for determining weighting coefficients on a space of input vectors and parameters of a plurality of sub-converting functions constituting part of said parameter converting function in accordance with an evaluation function which represents a difference between said input vector and said conversion output vector, said weighting function including a radial basis function having a non-increasing output value for an increase in the distance between a central vector of the M-dimension defined on said input vector space and each said input vector, wherein said conversion output vectors are representation of the phonemes in said input speech signal.

8. The parameter determining method according to claim 7, wherein, at said second step, parameters which make said difference smaller than a previously set evaluation value are employed as parameters of said parameter converting function.

9. The parameter determining method according to claim 8, wherein said second step comprises:

a third step of determining initial values for the parameters of said weighting function;

a fourth step of updating the parameters of said plurality of sub-converting functions with the parameters of said weighting function being fixed;

a fifth step of updating the parameters of said weighting function with the parameters of said plurality of sub-converting functions being fixed to values derived at said fourth step;

a sixth step of calculating the value of said difference from the parameters of said sub-converting functions derived at said fourth step, the parameters of said weighting function derived at said fifth step, and said evaluation function; and a seventh step of comparing said difference value calculated at said sixth step with said evaluation value to determine whether the former is smaller than the latter.

10. The parameter determining method according to claim 9, wherein if said difference value is larger than said evaluation value at said seventh step, said fourth, fifth, and sixth steps are repeated.

11. The parameter determining method according to claim 7, wherein said evaluation function is derived by calculating a square of the difference between said input vector and said conversion output vector of said learning sample set forth each of elements in said learning sample set, and adding all the calculated squares.

12. The parameter determining method according to claim 9, wherein, at said fourth step, said evaluation function is partially differentiated by the parameters of said sub-converting functions, and the parameters of said sub-converting functions are derived by solving simultaneous equations derived thereby.

13. The parameter determining method according to claim 9, wherein, at said fifth step, the parameters of said weighting function are updated by using a gradient descent method.

14. A speech synthesizing method comprising:

a first step of receiving speech synthesis input information including phoneme series information and accent information representative of the contents of speech;

a second step of generating and outputting a plurality of sound spectrum parameters corresponding to said speech synthesis input information;

a third step of converting said plurality of sound spectrum parameters to a desired sound spectrum parameter by a predetermined parameter converting function constituted of a plurality of sub-converting functions and a weighting function for setting weighting coefficients on a space of vectors of said sound spectrum parameters, said weighting function including a radial basis function having a non-increasing output value for an increase in the distance between a central vector of the M-dimension defined on said vector space of said sound spectrum parameters and each said sound spectrum parameter; and a fourth step of synthesizing a speech waveform corresponding to said desired sound spectrum parameter by using said desired sound spectrum parameter, wherein said third step includes the steps of:

converting said plurality of sound spectrum parameters by using said plurality of sub-converting functions to generate respective conversion outputs;

giving said weighting coefficients to said conversion outputs to generate weighted conversion outputs; and calculating the sum of said weighted conversion outputs and outputting said sum output as said desired sound spectrum parameter.

15. The speech synthesizing method according to claim 14, wherein a Gaussian Kernel function is used as said radial basis function.

16. The speech synthesizing method according to claim 14, wherein a distance function is used as said radial basis function.

17. The speech synthesizing method according to claim 14, wherein linear functions are used as said sub-converting functions.

18. The speech synthesizing method according to claim 14, wherein polynomial functions each including two or more terms are used as said sub-converting functions.

19. The speech synthesizing method according to claim 14, wherein functions each expressed by a neural network are used as said sub-converting function.

20. The speech synthesizing method according to claim 14, wherein the parameters of said parameter converting function are determined by a method comprising:

a fifth step of providing a learning sample set including a predetermined number of learning samples each including a pair of M-dimensional vectors and N-dimensional vectors; and a sixth step of determining parameters of a weighting function and parameters of a plurality of sub-converting functions constituting part of said parameter converting function in accordance with an evaluation function which represents a difference between said input vector and said conversion output vector of said parameter converting function.

21. The speech synthesizing method according to claim 20, wherein, at said sixth step, parameters which make said difference smaller than a previously set evaluation value are employed as the parameters of said parameter converting function.

22. The speech synthesizing method according to claim 20, wherein said sixth step comprises:

a seventh step of determining initial values for the parameter of said weighting function;

an eighth step of updating the parameters of said plurality of sub-converting functions with the parameters of said weighting function being fixed;

a ninth step of updating the parameters of said weighting function with the parameters of said plurality of sub-converting functions being fixed to values derived at said eighth step;

a tenth step of calculating the value of said difference from the parameters of said sub-converting functions derived at said eighth step, the parameters of said weighting function derived at said ninth step, and said evaluation function; and an eleventh step of comparing said difference value calculated at said tenth step with said evaluation value to determine whether the former is smaller than the latter.

23. The speech synthesizing method according to claim 22, wherein if said difference value is larger than said evaluation value at said eleventh step, said eighth, ninth, and tenth steps are repeated.

24. The speech synthesizing method according to claim 20, wherein said evaluation function is derived by calculating a square of the difference between said input vector and said conversion output vector of said learning sample set for each of elements in said learning sample set, and adding all the calculated squares.

25. The speech synthesizing method according to claim 20, wherein,at said sixth step, said evaluation function is partially differentiated by the parameters of said sub-converting functions, and the parameters of said sub-converting functions are derived by solving simultaneous equations derived thereby.

26. The speech synthesizing method according to claim 20, wherein, at said sixth step, the parameters of said weighting function are updated by using a gradient descent method.

27. An apparatus for synthesizing an input speech signal comprising:

a receiver for receiving M-dimensional input vectors;

a convertor for converting said M-dimensional input vectors to N output vectors in accordance with a predetermined parameter converting function, wherein said output vectors are representative of the phonemes in said input speech signal; and said parameter converting function comprises a plurality of sub-converting functions and a weighting function for setting weighting coefficients related to a predetermined space within which each of said M-dimensional input vectors exists.

28. An apparatus for speech synthesis according to claim 27 wherein said weighting function comprises a radial basis function having a non-increasing output value where there is an increase in a distance between a predetermined central vector and a said M-dimensional input vector.

29. An apparatus for speech synthesis according to claim 27 wherein said convertor converts said M-dimensional input vectors in accordance with said plurality of sub-converting functions so as to generate respective conversion outputs, assigns said weighting coefficients to said conversion outputs to provide a weighted conversion output, and calculates the sum of said weighted conversion outputs to derive output vectors.

* * * * *